US006885754B2

(12) United States Patent
Lazzeroni et al.

(10) Patent No.: US 6,885,754 B2
(45) Date of Patent: Apr. 26, 2005

(54) HELMET HEADSET SYSTEM AND METHOD

(76) Inventors: John J. Lazzeroni, 1415 S. Cherry Ave., Tucson, AZ (US) 85713-1997; Melinda K. Carevich, 1415 S. Cherry Ave., Tucson, AZ (US) 85713-1997

( * ) Notice: Subject to any disclaimer, the term of this patent is extended or adjusted under 35 U.S.C. 154(b) by 0 days.

(21) Appl. No.: 10/725,705

(22) Filed: Dec. 2, 2003

(65) Prior Publication Data

US 2004/0109580 A1 Jun. 10, 2004

Related U.S. Application Data

(62) Division of application No. 09/441,392, filed on Nov. 16, 1999, now abandoned.

(51) Int. Cl.[7] ..... H04R 25/00

(52) U.S. Cl. ..... 381/384; 381/375; 381/376; 381/370; 379/430; 455/575.2

(58) Field of Search ..... 381/376, 370, 381/375, 384; 379/430, 449; 455/575.1, 575.2, 575.3, 575.4, 575.5, 575.6, 575.7, 575.8, 575.9

(56) References Cited

U.S. PATENT DOCUMENTS 6,075,857 A * 6/2000 Doss et al. ..... 379/430

* cited by examiner

*Primary Examiner*—Curtis Kuntz
*Assistant Examiner*—Tuan Duc Nguyen
(74) *Attorney, Agent, or Firm*—Birdwell & Janke, LLP

(57) ABSTRACT

A helmet headset system for use with an audio system and a helmet. The helmet headset system comprises a mount for mounting to the helmet, and first and second audio signal conduits, e.g. each comprising a coil cord, and each having first and second ends. The first end of the first audio signal conduit is coupled to the mount. The first end of the second audio signal conduit is detachably coupled to the second end of the first audio signal conduit, and the second end of the second audio signal conduit is detachably coupled to the audio system. In a related aspect, the system may comprise a single, detachable audio signal conduit. Related methods also are provided.

41 Claims, 3 Drawing Sheets

HELMET HEADSET SYSTEM AND METHOD

REFERENCE TO RELATED APPLICATION

This application is a divisional of U.S. patent application Ser. No. 09/441,392, filed Nov. 16, 1999 now abandoned.

BACKGROUND OF THE INVENTION

1. Field of the Invention

This invention relates generally to audio headset systems, and accessory mounts systems for use with helmets, and for use with audio systems such as citizen's band ("CB") radios, stereos, intercoms, tape and compact disk ("CD") players, and the like. Examples of such audio accessories include microphone assemblies, speakers and the like. The invention also relates to methods pertaining to such headset and accessory mount systems.

2. Description of the Related Art

Helmets are widely used to enhance the safety of an individual wearer in a variety of activities, such as riding motorcycles, snowmobiles, and other vehicles. It is often useful or desirable while wearing a helmet to communicate with other individuals, listen to a radio or stereo, etc. Such activities have become increasingly popular in recent years, as recreational vehicles such as touring motorcycles have come to be equipped with bike-to-bike intercom systems, CB radios, stereo radio sets, and other high-quality electrical communications or audio equipment or systems.

For some time now it has been advantageous in the use of such audio systems to attach accessories or components of the audio system, such as the microphone assembly and speakers, directly to the helmet. This facilitates use of the audio equipment by the helmet wearer while minimizing the interference with the wearer's operation of the vehicle, and thereby maximizing the safety of the wearer. They make it unnecessary, for example, for the user of a CB radio or intercom to use a hand-held microphone, which may prevent the user from maintaining both hands on the handlebars or controls.

In such headset or mount designs, it is generally desirable to mount a microphone assembly so that the microphone is generally positioned near the wearer's mouth. The headset or mount also generally is coupled to a pair of speakers mounted in the helmet, typically by a corresponding pair of wires. The headset or mount also typically is adapted to receive an electrical connector such as a connector attached to the electrical cord extending from the audio system (e.g., the radio, stereo, etc.) and which electrically communicates with the microphone and speakers. In this manner the user can interface the audio accessories merely by listening or speaking. This approach to headsets and mounts has created a need for headset designs and associated mounting systems that securely mount the desired audio system accessories to the helmet.

Audio headsets and mounts for securely mounting audio accessories to the helmet are known, and have been the subject of a number of U.S. patents. U.S. Pat. No. Re. 34,525, issued to Lazzeroni and Carevich in February 1994, and U.S. Pat. No. 5,590,209, issued to Pratt on Dec. 31, 1996, are two examples. The Lazzeroni and Carevich patent, for example, discloses a headset mount design that uses a clamp to securely attach the audio accessories to a location at or near the bottom edge of the helmet without the need to drill holes in the helmet. The Pratt patent discloses a mount that is fastened to the outer side of the helmet using a layer of adhesive material to secure the mount to the helmet without violating the integrity of the latter.

As the use of audio systems has become more widespread, it has become increasingly common for a given individual to have more than one audio system for which use may be made while wearing a helmet. It is not unusual, for example, for a given individual to have not only an audio system on a motorcycle, but also to have an audio system on a snowmobile, or to have a hand-held audio system mounted on a bicycle. Similarly, it is becoming increasingly common for a given individual to wish to use his or her helmet and headset not only with his or her own audio system, but also with the audio system of a friend, such as when riding the friend's motorcycle or snowmobile. This often requires use of a given helmet with different types of audio systems. These trends have give rise to a need for headsets and headset mounts that are flexible, adaptable and interchangeable.

A general limitation of such known headset designs has resided in the fact that many of such headset designs mount the accessory or accessories to the helmet in a permanent or semi-permanent manner, and provide only a single type of connector or audio system interface. This makes it relatively difficult or cumbersome to change or replace an accessory or use it with more than one type of audio system, thereby limiting the flexibility of the system. The Lazzeroni and Carevich system of U.S. Pat. No. Re. 34,525 provided a significant improvement over the prior art, for example, by providing a detachable clamping design wherein the headset or mount could be relatively easily detached from the helmet, for example, by adjusting a pair of machine bolts. Even that system as disclosed in the patent, however, does not provide for interchange of the accessories, for example, to replace a microphone assembly or to change a connector type, without removing and replacing the entire mount.

This general limitation has become more pronounced in recent years based on changes to the microphone design, for example, based on the presence of amplified or preamplified microphones, such as what are commonly referred to as "condenser" microphones. Microphones traditionally have utilized a design commonly referred to as a "dynamic" microphone design, which uses a diaphragm and voice coil to generate the audio signal and transmit it to amplification circuitry incorporated into the audio system, as opposed to the headset itself. This design or type of microphone has been advantageous, for example, in that it is amenable to efficient and in some cases quite effective noise cancellation techniques. With amplified or preamplified microphone designs, an amplifier or preamplifier circuit is positioned at or near the microphone itself, as part of the headset system. This allows the audio signal to be amplified at its source, before being transmitted to the audio system. The signal-to-noise ratio, and thus the quality of the audio signal, also can be substantially improved using this approach. Within each of these general design categories, there are a number of designs. Moreover, there are various other microphone designs and approaches.

Each microphone design has implications for the design of the audio system with which it is intended to operate, and particularly for the interface of that audio system. Many of the newer audio systems require preamplified microphones. The specific level of preamplification required may vary from audio system to audio system. The use of a preamplifier typically requires a power source to be applied to the preamplifier, which adds a requirement at the audio system interface for this power source to be supplied, usually from the audio system. In summary, use of various audio systems and the corresponding microphone designs have implications as to the specific design requirements for headsets usable with such audio systems.

This variability from audio system to audio system can be disadvantageous in that, if one is to use more than one type or design of audio system, a single headset of known design probably will not be sufficient. The headset user therefore is placed in a position of having to obtain a different headset for each design of audio system, and of having to have the appropriate one available when it is needed. The cost of using headsets for more than one audio system type therefore is increased, and the use of headset systems is made more cumbersome and inconvenient.

OBJECTS OF THE INVENTION

Accordingly, an object of the invention is to provide a helmet headset system and method for mounting a helmet headset system to a helmet for use with an audio system, wherein the system and method are sufficiently flexible and adaptable as to be usable with more than one type of audio system.

Another object of the invention is to provide a helmet headset system and method for mounting a helmet headset system to a helmet for use with an audio system, wherein the cost of the system and method are low relative to the cost of providing multiple headsets for use with more than one type of audio system.

Additional objects and advantages of the invention will be set forth in the description, which follows, and in part will be apparent from the description, or may be learned by the practice of the invention. The objects and advantages of the invention may be realized and obtained be means of the instrumentalities and combinations pointed out in the appended claims.

SUMMARY OF THE INVENTION

To achieve the foregoing objects, and in accordance with the purposes of the invention as embodied and broadly described in this document, a helmet headset system is provided for use with an audio system and a helmet. The helmet headset system according to one aspect of the invention comprises a mount for mounting to the helmet, a first audio signal conduit having first and second ends, and a second audio signal conduit having first and second ends. The first end of the first audio signal conduit is coupled to the mount. The first end of the second audio signal conduit is detachably coupled to the second end of the first audio signal conduit, and the second end of the second audio signal conduit is coupled, preferably detachably, to the audio system. Preferably but optionally, the first end of the first audio signal conduit is detachably coupled to the mount. The system preferably but optionally also includes a microphone operatively coupled to the mount. The system also preferably includes at least one speaker, and preferably at least two speakers, coupled to the mount and operatively coupled to the first end of the first audio signal conduit.

In accordance with this aspect of the invention, the system preferably also includes a circuit for electrically coupling the first end of the first audio signal conduit to the microphone. The circuit includes first and second input terminals for receiving an input signal from the microphone. An amplification circuit is electrically coupled to the first and second input terminals. The amplification circuit has an output operatively coupled to the first end of the first audio signal conduit. The circuit also preferably includes a common ground electrically coupled to the second input terminal. A third input terminal also is provided for receiving the input signal from the microphone. The third input terminal is operatively coupled to the first end of the first audio signal conduit.

In accordance with another aspect of the invention, a helmet headset system is provided for use with first and second audio systems and a helmet. The helmet headset system comprises a mount for mounting to the helmet, and first, second and third audio signal conduits. Each of the first, second and third audio signal conduits includes a first and a second end. The first end of the first audio signal conduit is coupled to the mount. The first end of the second audio signal conduit is detachably coupled to the second end of the first audio signal conduit, and the second end of the second audio signal conduit is coupled to the first audio system, preferably detachably. The first end of the third audio signal conduit is coupled to the second end of the first audio signal conduit and the second end of the third audio signal conduit is coupled to the second audio system, preferably detachably, when the second audio signal conduit is detached from the first audio signal conduit. Preferably, the first end of the first audio signal conduit is detachably coupled to the mount.

The system preferably also includes a microphone operatively coupled to the mount. It also preferably includes at least one speaker, and preferably at least two speakers, coupled to the mount and operatively coupled to the first end of the first audio signal conduit.

In accordance with this aspect of the invention, the system preferably but optionally includes a circuit for electrically coupling the first end of the first audio signal conduit to the microphone. The circuit includes first and second input terminals for receiving an input signal from the microphone, and an amplification circuit electrically coupled to the first and second input terminals. The amplification circuit has an output operatively coupled to the first end of the first audio signal conduit. The circuit also includes a common ground electrically coupled to the second input terminal, and a third input terminal for receiving the input signal from the microphone. The third input terminal is operatively coupled to the first end of the first audio signal conduit.

In accordance another aspect of the invention, a helmet headset system is provided for use with an audio system and a helmet. The helmet headset system according to this aspect of the invention comprises a mount for mounting to the helmet, and an audio signal conduit having first and second ends. The first end of the audio signal conduit is detachably coupled to the mount, and the second end of the audio signal conduit is detachably coupled to the audio system. The system according to presently preferred embodiments also includes a microphone operatively coupled to the mount, and at least one speaker, and preferably at least two speakers, coupled to the mount and operatively coupled to the first end of the audio signal conduit.

Also in accordance with this aspect of the invention, the system preferably but optionally includes a circuit for electrically coupling the first end of the audio signal conduit to the microphone. The circuit includes first and second input terminals for receiving an input signal from the microphone, and an amplification circuit electrically coupled to the first and second input terminals. The amplification circuit has an output operatively coupled to the first end of the first audio signal conduit. The circuit also includes a common ground electrically coupled to the second input terminal, and a third input terminal for receiving an input signal from the microphone. The third input terminal is operatively coupled to the first end of the first audio signal conduit.

In accordance with another aspect of the invention, a helmet headset system is provided for use with an audio system and a helmet. The helmet headset system comprises a mount for mounting to the helmet, and an audio signal conduit having first and second ends. The first end of the audio signal conduit is coupled to the mount and the second end of the audio signal conduit is operatively coupled to the audio system.

The system according to this aspect of the invention also includes a circuit for electrically coupling the first end of the audio signal conduit to a microphone. The circuit includes first and second input terminals for receiving an input signal from the microphone, and an amplification circuit electrically coupled to the first and second input terminals. The amplification circuit has an output operatively coupled to the first end of the audio signal conduit. The circuit according to this system also includes a common ground electrically coupled to the second input terminal, and a third input terminal for receiving the input signal from the microphone. The third input terminal is operatively coupled to the first end of the audio signal conduit.

Preferably, the audio signal conduit comprises a first audio signal conduit segment and a second audio signal conduit, each having first and second ends. The first end of the first audio signal conduit segment is coupled to the mount. The first end of the second audio signal conduit segments is detachably coupled to the second end of the first audio signal conduit segment, and the second end of the second audio signal conduit segment is coupled, preferably detachably, to the audio system.

In accordance with another aspect of the invention, a method is provided for mounting a helmet headset system to a helmet for use with an audio system. The method comprises a first step of mounting a mount to the helmet, a second step of coupling a first audio signal conduit having first and second ends to the mount so that the first end of the first audio signal conduit is coupled to the mount, and a third step of coupling a second audio signal conduit having first and second ends to the first audio signal conduit and to the audio system so that the first end of the second audio signal conduit is detachably coupled to the second end of the first audio signal conduit and the second end of the second audio signal conduit is coupled to the audio system. The second step preferably includes detachably coupling the first end of the first audio signal conduit to the mount.

The method optionally but preferably may include a fourth step of operatively coupling a microphone to the mount. The method also may include a step of coupling at least one speaker, and preferably at least two, to the mount and operatively coupling the at least one speaker to the first end of the first audio signal conduit.

In accordance with yet another aspect of the invention, a method is provided for mounting a helmet headset system to a helmet for use with first and second audio systems. The method comprises a first step of mounting a mount to the helmet, a second step of coupling a first audio signal conduit having first and second ends to the mount so that the first end of the first audio signal conduit is coupled to the mount, a third step of coupling a second audio signal conduit having first and second ends to the first audio signal conduit and to the first audio system so that the first end of the second audio signal conduit is detachably coupled to the second end of the first audio signal conduit and the second end of the second audio signal conduit is coupled to the first audio system, a fourth step of coupling a third audio signal conduit having first and second ends to the first end of the first audio signal conduit so that the third audio signal conduit is detachably coupled to the second end of the first audio signal conduit and the second end of the third audio signal conduit is coupled to the second audio system when the second audio signal conduit is detached from the first audio signal conduit. The second step preferably includes detachably coupling the first end of the first audio signal conduit to the mount.

The method may and preferably does include a fifth step of operatively coupling a microphone to the mount, and a step of coupling at least one speaker to the mount and operatively coupling the at least one speaker to the first end of the first audio signal conduit.

In accordance with still another aspect of the invention, a method is provided for mounting a helmet headset system to a helmet for use with an audio system. The method includes a first step of mounting a mount to the helmet, and a second step of coupling an audio signal conduit having first and second ends to the mount so that the first end of the audio signal conduit is detachably coupled to the mount and the second end of the audio signal conduit is coupled to the audio system.

The method preferably includes a third step of operatively coupling a microphone to the mount, and a step of coupling at least one speaker to the mount and of operatively coupling the at least one speaker to the first end of the first audio signal conduit.

With the preferred embodiments and methods as described herein, it is possible to provide a headset system that can be used with more than one audio system or audio system type, without requiring a new or different headset for each such audio system or audio system type. One need only replace an audio signal conduit or conduit segment while continuing to use the remainder of the headset system. This can greatly facilitate the efficiency and convenience of using headset systems, and can provide substantial cost savings over the approach of using multiple, complete headsets or headset systems.

BRIEF DESCRIPTION OF THE DRAWINGS

The accompanying drawings, which are incorporated in and constitute a part of the specification, illustrate presently preferred embodiments and methods of the invention and, together with the general description given above and the detailed description of the preferred embodiments and methods given below, serve to explain the principles of the invention.

DETAILED DESCRIPTION OF THE PREFERRED EMBODIMENTS AND METHODS

Figure 2:
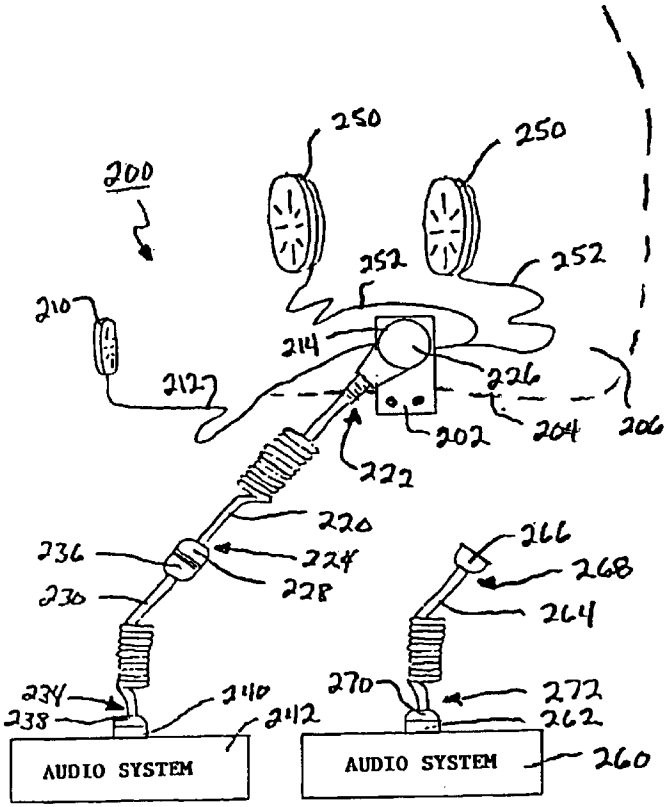
FIG. 2 shows a second preferred embodiment of a helmet headset system according to another aspect of the invention, connected to an audio system.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments. The invention according to its various aspects is particularly pointed out and distinctly claimed in the attached claims read in view of this specification, and appropriate equivalents.

In accordance with one aspect of the invention, a helmet headset system is provided for use with an audio system and a helmet. The helmet may take any one of a variety of forms. It may, for example, comprise an "open face" helmet, a "full face" helmet, a "half" helmet, and the like. The audio system may comprise any one of a variety of audio components or subsystems. Examples would include a CB radio, intercom, tape player, CD player, and the like. Such audio systems are commonly found on new and used touring motorcycles. They may be provided with the vehicle when new or retrofitted. Examples of vehicles that include such audio systems include the Honda Goldwing, the Harley-Davidson Ultra Classic, the BMW K1200LT, and others. Such audio systems typically are designed to operate with accessories that are part of a headset system. Examples of such accessories include microphones, with or without a microphone boom or gooseneck, helmet speakers, related electrical connectors and components, and the like.

The helmet headset system according to this aspect of the invention includes a mount for mounting to the helmet. The mount is a device, component or assembly that mounts or attaches to the helmet and attaches or supports accessories to the helmet. The mount may take a number of forms. Preferred mounts include those shown and described in U.S. Pat. No. Re. 34,525, and those commercially available from J&M Corporation of Tucson, Ariz., for example, such as J&M's 1999 HS-ECD269 headset system.

Figure 1:
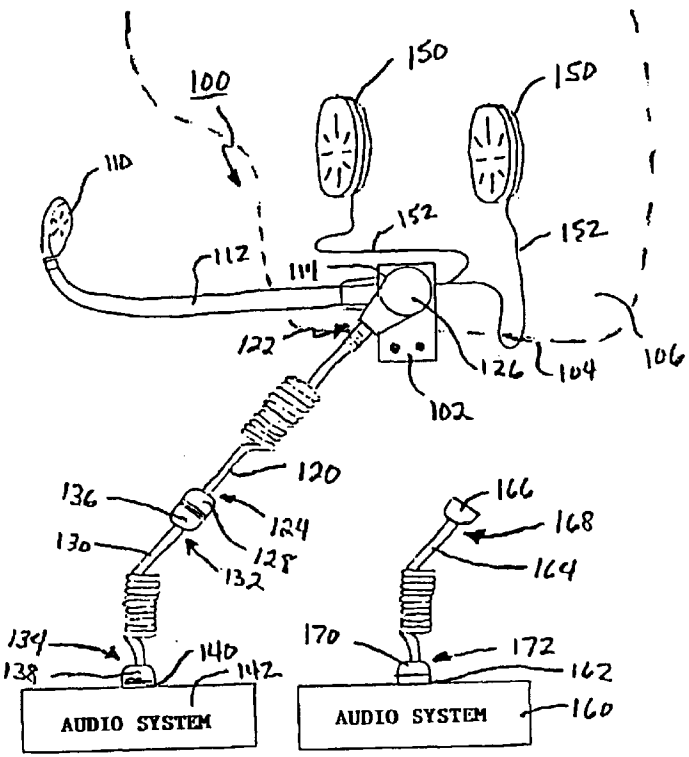
FIG. 1 shows a helmet headset system according to a first preferred embodiment of the invention, connected to an audio system.

A helmet headset system 100 according to a first preferred embodiment of the invention is shown in FIG. 1. Helmet headset system 100 includes a mount 102, which preferably is for attachment to the bottom or lower edge 104 of helmet 106. Mount 102 includes a clamp as generally shown in U.S. Pat. No. 34,525, and as is available on J&M's 1999 Model HS-ECD269 headset, commercially available from J&M Corporation. The specific design of mount 102 is not, however, necessarily limiting. A number of different mount designs could be used.

System 100 further includes a microphone 110 supported by a microphone support 112 extending from mount 102. Microphone 110 may comprise any one of a number of designs. In accordance with this preferred embodiment, microphone 110 comprises an AEROMIKE®microphone as is provided on J&M's 1999 Model HS-E164JH and its 1999 Model HS-ECD269 headsets, or a tunable microphone designed in accordance with U.S. Pat. No. 5,329,593, issued to Lazzeroni and Carevich on Jul. 12, 1994. Microphone support 112 preferably comprises a microphone boom or gooseneck. One or more wires (not shown) extend from microphone 110 through support boom 112 to mount 102. These wires are operatively coupled to a connector 114 incorporated into mount 102. They are "operatively coupled" in that, in the course of their normal operation, they communicate with one another so that a signal impressed upon these wires is communicated to connector 114. The term "operatively coupled" as used herein is used according to its common but broad meaning to include coupling or interaction when the devices or components are operated.

In accordance with this aspect of the invention, the helmet headset system comprises a first audio signal conduit having first and second ends. The first end of the first audio signal conduit is coupled to the mount. The first audio signal conduit again may take a variety of forms, depending on the specific application, the nature of the audio signal, etc. Preferred audio signal conduits include wires for transmitting and electrical audio signal. A coil cord such as those currently commercially available for known headset systems would be an example, absent, of course, the specific modifications according to the invention as described herein. Coil cords commercially available from J&M Corporation of Tucson, Ariz. for model years 1998 and prior would be examples of such known coil cords. It is also possible, however, to provide the first audio signal conduit as an optical fiber or cable for transmitting an audio signal in the form of an optical or digital signal.

As implemented in the first preferred embodiment, the first audio signal conduit comprises an electrical coil cord 120. Coil cord 120 includes a first end 122 and a second end 124. A connector 126 is provided at first end 122 of coil cord 120. Connector 126 is coupled to, and optionally but preferably detachably coupled to, mount connector 114. This meeting is such that connector 126 both mechanically and electrically couples with mount connector 114. A connector 128 is provided at second end 124 of coil cord 120.

Still in accordance with this aspect of the invention, the helmet headset system comprises a second audio signal conduit having first and second ends. The first end of the second audio signal conduit is detachably coupled to the second end of the first audio signal conduit. The second end of the second audio signal conduit is detachably coupled to the audio system. Again, the second audio signal conduit may take the same forms, and the same variety of forms, as the first audio signal conduit. Preferably, the first and second audio signal conduits are of like or identical design and structure, and are adapted to effectively communicate the same types of audio signals.

As implemented in the preferred embodiment according to this aspect of the invention, system 100 includes a second audio signal conduit in the form of a coil cord 130 having a first end 132 and a second end 134. A connector 136 is provided at first end 132 of coil cord 130. Connector 136 mates with and physically and electrically couples to connector 128 of first coil cord 120.

A connector 138 is provided at second end 134 of coil cord 130. Connector 138 is adapted to mate with and electrically and mechanically couple to a connector 140 of a first audio system 142. Connector 138 is specifically designed to work with or be compatible with audio system 142, or at least with audio systems having the same mechanical and electrical interface as audio system 142, and therefore of the same "type" as audio system 142. It should be noted, incidentally, that connectors 138 need not necessarily be detachable, and coil cord 130 may be permanently or fixedly attached to the audio system. Preferably, however, the second coil cord is detachable from the audio system.

Audio system 142 may be any system capable of transmitting, receiving, or transmitting and receiving an audio signal or similar signal for use with speakers, microphones, or both. Examples of audio systems for use with audio headset system 100 include radio receivers, intercoms, tape players, compact disk players, CB radios, and the like. The audio signal preferably would be an electric analog or digital signal, but may comprise other forms, e.g., such as an optical or infrared signal.

The helmet headset system according to the preferred embodiment optionally but preferably includes at least one speaker, and preferably at least two speakers, coupled to the mount and operably coupled to the first end of the first audio signal conduit. As implemented in the preferred embodiment of FIG. 1, system 100 includes a pair of audio speakers 150 coupled to mount, and specifically to connector 114 of mount 102, by a pair of wires 152. Speakers 150 preferably comprise a pair of DYNAPORT® speakers such as those commercially available as a component of J&M's 1999 Model HS-E164JH headset system, its 1999 HS-Model ECD269 headset system, or other speakers designed in accordance with U.S. Pat. No. 4,977,975, issued to Lazzeroni et al. on Dec. 18, 1990.

In operation, audio signals from audio system 142, such as stereo radio signals, another system user's voice from an intercom system, etc., travel from connector 140, through second coil cord 130 and first conduit 120, via connectors 126 and 114, and ultimately to speakers 150 via speaker wires 152. When the wearer of system 100 speaks into microphone 110, his or her voice is transduced into an electrical audio signal by microphone 110. The electrical audio signal then propagates via the wire in boom 112 to connectors 114 at mount 102. The signal then is communicated via connector 126 through first coil cord 120 and second coil cord 130 to audio system 142.

In accordance with an aspect of the invention, the helmet headset system may include a third audio signal conduit having first and second ends. The first end of the third audio signal conduit may be detachably coupled to the second end of the first audio signal conduit and the second end of the third audio signal conduit may be coupled, preferably detachably, to the second audio system when the second audio signal conduit is detached from the first audio signal conduit.

If the user of system 100 elects to use a different audio system 160 having a connector 162 that is different in design from first audio system connector 140, for example, one may merely use a third audio signal conduit 164 very similar to conduit 130, but adapted to be mated with and connected to audio system 160 instead of audio system 142. Accordingly, coil cord 164 would include a connector 166 at its first end 168 that is electrically compatible with audio system 160, but which physically and electrically mates to connector 128 of coil cord 120. Coil cord 164 also includes a connector 170 at its second end 172 that is adapted to be mechanically and electrically coupled and mated with audio system connector 162. When the user of system 100 elects to use system 100 with audio system 160 instead of audio system 142, he or she merely detaches connector 128 of coil cord 120 from connector 136 of coil cord 130, and attaches connector 128 to connector 166 of coil cord 164. In this way, the same headset system may be used with different audio systems of different connector types without replacing the entire headset system. It is only necessary using this preferred embodiment to replace a single coil cord or coil cord segment, e.g., replacing coil cord 130 with coil cord 164, to enable the user to use the existing headset components with the new audio system.

The preferred embodiment as shown and described with regard to FIG. 1 is adapted for use with an "open face" style helmet. It may be adapted with slight modification, however, for use with "full face" helmet designs. An example of such a headset or mount is shown as system 200 in FIG. 2. The only difference between system 200 and the previously-shown and described system 100 of FIG. 1 is the substitution of a microphone wire 212 in system 200 for the boom structure 112 of system 100. It may be desirable, in addition, to use a noise canceling microphone, for example, as disclosed in U.S. Pat. No. 5,684,880, issued to Lazzeroni et al. on Nov. 4, 1997. System 200 uses coil cords 220, 230 and 264 identical to coil cords 120, 130 and 164, respectively. System 200 also operates in the same manner as system 100 to be adaptable and usable with two different audio systems 242 and 260, just as with audio systems 142 and 160 in FIG. 1.

In accordance with another aspect of the invention, a helmet headset system is provided for use with an audio system and a helmet. The audio system and helmet with which the system may be used may be as described above. In accordance with this aspect of the invention, the helmet headset system includes a mount for mounting to the helmet. The mount also may be as described above.

Figure 3:
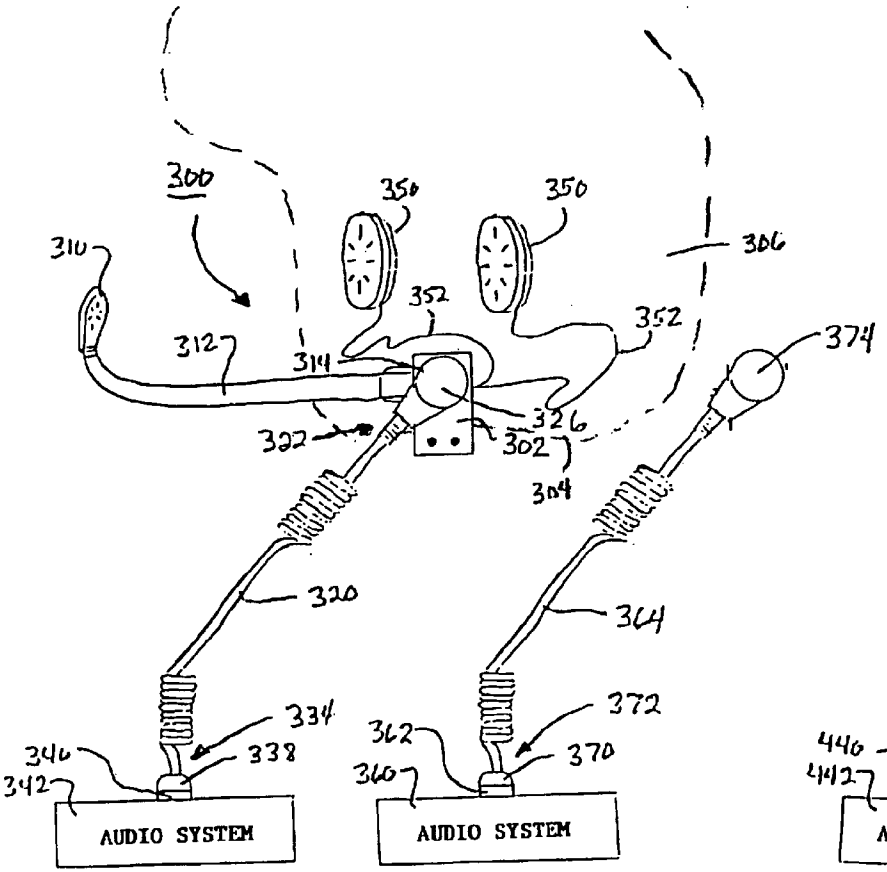
FIG. 3 shows a third preferred embodiment of a helmet headset system according to another aspect of the invention, connected to an audio system.

A helmet headset system 300 is shown in FIG. 3. Audio system 300 includes a mount 302 identical to mount 102. Mount 102 is adapted to be attached to the lower edge 304 of a helmet 306 as described above. System 300 includes a microphone 310 similar or identical to microphone 110, attached to and supported by a microphone support 312. A wire (not shown) extends from microphone 310 through microphone support 312 to a mount connector 314.

In accordance with this aspect of the invention, the helmet headset system comprises an audio signal conduit having first and second ends. The first end of the audio signal conduit is detachably coupled to the mount, and the second end of the audio signal conduit is detachably coupled to the audio system.

As implemented in preferred system 300 and with reference to FIG. 3, the audio signal conduit is provided in the form of a coil cord 320 having a first end 322 and a second end 334. A connector 326 is provided at first end 322 of coil cord 320. Connector 326 mates mechanically and couples electrically with mount connector 314. A connector 338 is provided at end 334 of coil cord 320. Connector 338 mates with mechanically and couples electrically to a connector 340 of an audio system 342.

System 300 differs from systems 100 and 200 primarily in that system 300 uses only a single coil cord 320 instead of separate coil cords or coil cord segments 120 and 130, respectively, for system 100 and coil cord segments 220 and 230, respectively, for system 200. A coil cord segment, incidentally, is synonymous with a coil cord, but refers to a coil cord that is intended to be used with at least one other coil cord, such as coil cords (or synonymously coil cord segments) 120 and 130. Thus, if the user of system 300 elects to use that system with a second audio system 360 having a connector 362 different in type from connector 340 of audio system 342, he or she need only substitute a different coil cord 364, similar to coil cord 320, but having a connector 370 adapted to mate with and connect to connector 362 of audio system 360. The user would attach a connector 374 to mount connector 314. Thus, the headset system components (e.g., the mount, microphone accessory, and speaker accessories) may be used interchangeably for both audio systems by merely having two coil cords 320 and 364.

Figure 4:
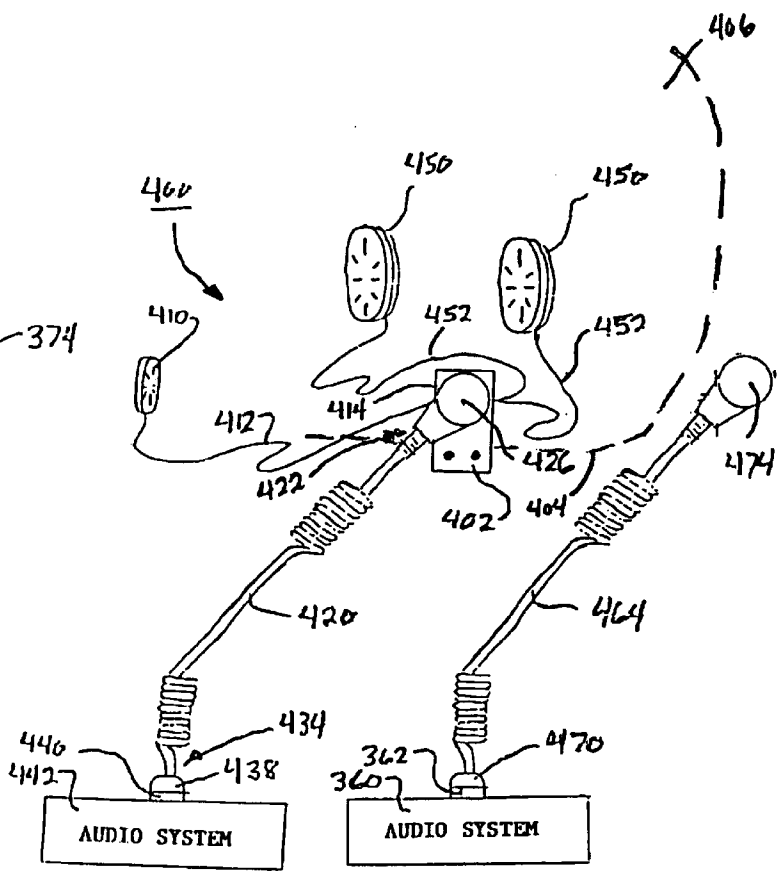
FIG. 4 shows a fourth preferred embodiment of a helmet headset system according to another aspect of the invention, connected to an audio system.

System 300 also may be adapted for use with other helmet types. For example, as shown in FIG. 4, a system 400 virtually identical to system 300, but including a microphone wire 412 rather than a microphone support or boom 312 may be provided for use with a "full face" helmet.

In accordance with another aspect of the invention, a helmet headset system is provided for use with an audio system and a helmet. The audio system and helmet may be as described above. In accordance with this aspect of the invention, the helmet headset system comprises a mount for mounting to the helmet. The mount may be as described above.

The system according to this aspect also comprises an audio signal conduit having first and second ends, the first end of the audio signal conduit being coupled to the mount and the second end of the audio signal conduit being operatively coupled to the audio system. The audio signal conduit according to this aspect of the invention may comprise an audio signal conduit as described above. It may include, for example, combined audio signal conduit segments, such as coil cords 120 and 130 (FIG. 1), or a single, integrated audio signal conduit, such as coil cord 320 (FIG. 3).

In accordance with this aspect of the invention, the helmet headset system includes a circuit for electrically coupling the first end of the audio signal conduit to a microphone. For purposes of illustrating the invention and the flexibility and other advantages it affords, this circuit will be described as being included in each of the preferred system embodiments as described above.

Figure 5:
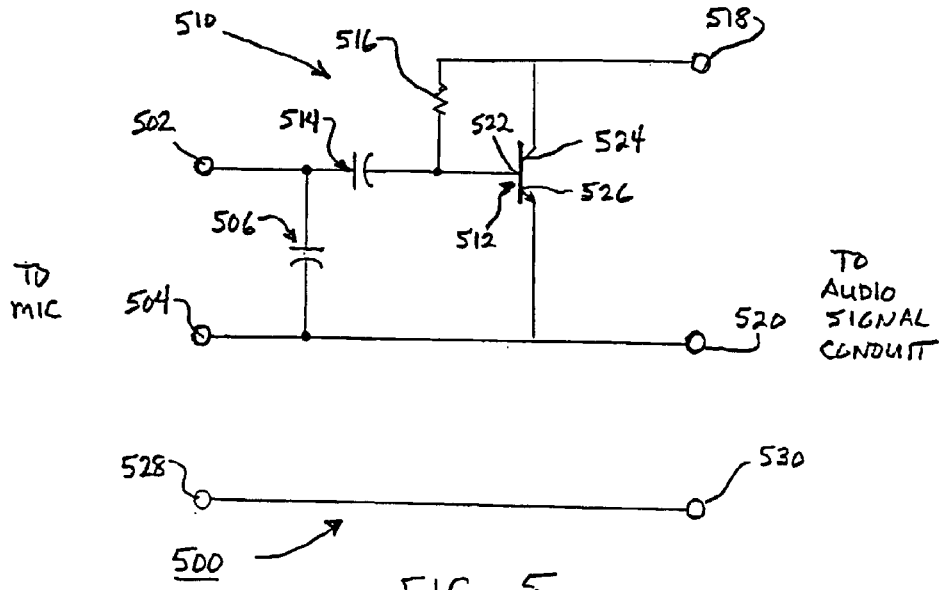
FIG. 5 shows an electrical schematic diagram of a circuit used in connection with the helmet headsets according to the preferred embodiments of the invention.

A circuit 500 according to a preferred embodiment of this aspect of the invention is shown in FIG. 5. Circuit 500 is mounted within the mount connector that is adapted to be mated with and coupled to the connector at the first end of the audio signal conduit, e.g., connector 114 for system 100, connector 214 for system 200, connector 314 for system 300 and connector 414 for system 400.

This circuit is adapted to operate with more than one type of audio system. For example, the preferred systems as described herein are designed to operate with an audio system that does not require amplification of the microphone signal, and a second, different audio system that requires amplification of the microphone signal. The system also may be implemented, for example, so that it can operate with a third audio system that requires amplification, but at an amplification level different from the one described herein for the second audio system.

The circuit according to this aspect of the invention includes first and second input terminals for receiving an input signal from the microphone. In accordance with the preferred embodiment, circuit 500 includes input terminals 502 and 504 for receiving an input signal from the microphone, e.g., microphone 110. A capacitor 506 is disposed between terminals 502 and 504. Capacitor 506 according to this preferred embodiment preferably has a capacitance of approximately 0.1 microfarad ($\mu$f).

The circuit according to this aspect of the invention also includes an amplification circuit electrically coupled to the first and second input terminals. The amplification circuit has an output operatively coupled to the first end of the first audio signal conduit. As implemented in the preferred embodiment, circuit 500 includes an amplification circuit 510 that comprises a transistor 512, a capacitor 514, a resistor 516, and output terminals 518 and 520. Transistor 512 in this specific embodiment comprises a bipolar junction transistor (2N4401). Capacitor 514 is coupled to the gate of transistor 512, and is positioned between the gate of transistor 512 and terminal 502. Capacitor 514 in this embodiment preferably has a capacitance of approximately 1.0 $\mu$f. Resistor 516, which in this embodiment preferably has a resistance of 1 mega ohm (M$\Omega$), is electrically coupled to the gate of transistor 522, and provides resistance in the path between the gate 522 and the base of transistor 524. The base of transistor 524 also is coupled to output terminal 518. Emitter 526 of transistor 512 is coupled to input terminal 504 and output terminal 520.

The circuit according to this aspect of the invention further includes a common ground electrically coupled to the second input terminal. As implemented in the preferred embodiment, Terminal 504 and the path extending between it and output terminal 520 constitute part of a common ground. Ideally, the common ground at terminals 504 and 520 is used for the microphones only, and is not used to ground speakers. This provides better sound quality and fidelity in the microphone audio signal.

The circuit according to this aspect of the invention also includes a third input terminal for receiving an input signal from the microphone. The third input terminal is operatively coupled to the first end of the first audio signal conduit. As implemented in this preferred embodiment, the third input terminal comprises an input terminal 528, which is coupled to an output terminal 530.

The headset system can adapt itself to varying types of audio systems, for example, by interchanging the audio signal conduit appropriate for the particular audio system or audio system type, e.g., coil cords 130 and 164 in system 100, coil cords 230 and 264 in system 200, coil cord 320 in system 300, and coil cord 420 in system 400. If the audio system with which the headset system is to be used does not require amplification, one uses a coil cord that provides corresponding internal conduits, preferably wires, for coupling to output terminals 520 and 530. In this instance, output terminal 518 would be grounded to limit or prevent unwanted noise or RF interference. The audio signal from the microphone would be applied at input terminals 504 and 528. As can be seen, these terminals simply provide the signal directly to output terminals 520 and 530, respectively, without amplification or other modification.

When the audio system to which the headset system is attached requires amplification, the audio signal conduit appropriate for that audio system includes the appropriate leads or pins so that output terminals 518 and 520 are engaged. The output signal thus extracted is amplified by amplifier circuit 510 at a level determined in known fashion from the design and component values for amplification circuit 510.

Figure 6:
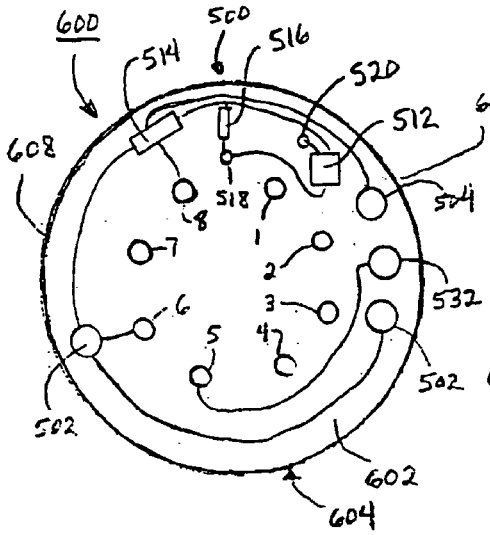
FIG. 6 shows a pictorial diagram of a first side of a printed circuit board used in connection with the preferred embodiments of the invention.
Figure 7:
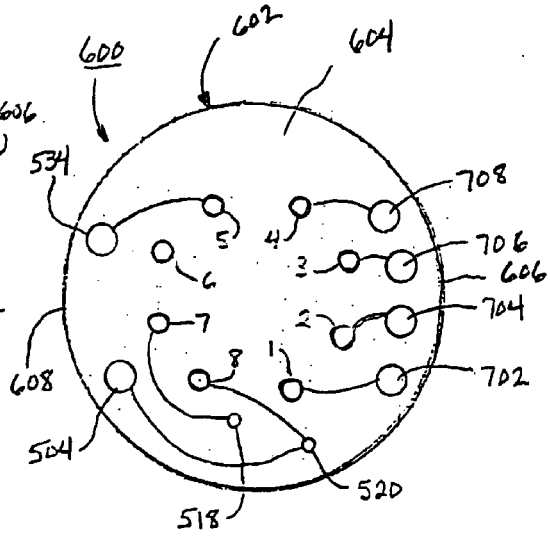
FIG. 7 shows a second side of the printed circuit board shown in FIG. 6.

A preferred implementation of circuit 500 comprising a circuit board 600 is shown in FIGS. 6 and 7. FIG. 6 shows a first side 602, and FIG. 7 shows a second side 604. PC board 600 preferably would be physically contained within the mount connector, e.g., mount connector 118 of system 100, mount connector 218 of system 200, mount connector 318 of system 300, and mount connector 418 of system 400.

With reference to FIG. 6, the first side 602 of PC board 600 includes eight pin receptacles, numbered 1 through 8 in the drawing figure. Each of these pin receptacles is adapted to receive, mate with, and/or operatively couple with a corresponding conduit, preferably a wire, in the audio signal conduit or conduits. Each of these pin receptacles conducts to the second side 604 of PC board 600, as shown in FIG. 7. This can be accomplished by providing vias through the PC board. At one side 606 of PC board 606, two metalized pads are provided to constitute terminals 502 and 504, and to receive audio input signals from the microphone, e.g., 110, 210, 310 and 410. Pads 502 and 504 at side 606 of PC board 600 preferably are adapted to be coupled to a full face headset system, examples of which are shown as systems 200 and 400 in FIGS. 2 and 4, respectively. A third metalized pad 532 is provided at side 606 of PC board 600, and is coupled by a metallization run (a conductor run extending as a line conductor on the surface of the PC board) to pin receptacle 5.

At the other side 608 of PC board 600, a pad is provided to constitute a second input terminal 502, this pad preferably being for an open face helmet headset system, examples of which are provided as systems 100 and 300 in FIGS. 1 and 3. If PC board 600 is to be used in an open face helmet headset system design, pad 502 at side 608 and surface 602 of board 600 preferably is used to electrically couple one of the wires (not shown) from the microphone, e.g., microphones 110 and 310.

A metallization run extends to electrically couple terminal 502 (both pads) to pin receptacle 6. A metallization run also extends to electrically couple terminal 504 to pin receptacle 8, which functions as the microphone ground (terminal 520). The metallization for pin receptacle 8 according to the embodiment shown in FIG. 6 runs under capacitor 514, but is not electrically coupled to it.

With reference to FIG. 7, four metallized pads 702, 704, 706 and 708 are provided adjacent to side 606 of PC board 600 for coupling to speaker wires 152 of speakers 150. A metallization run extends to electrically couple pin receptacle 1 to a pad 702. A metallization run also extends to electrically couple pin receptacle 2 to pad 704. Similarly, a metallization run extends to electrically couple pin receptacle 3 to pad 706. Finally, a metallization run extends to electrically couple pin receptacle 4 to pad 708.

A pad corresponding to and comprising input terminal 504 for an open face helmet system is provided at side 608 and surface 604 of PC board 600. A metallization extends to couple pad 504 at side 608 to the via adjacent to pin receptacle 1 comprising terminal 520, and further extends to couple this pad 504 electrically to pin receptacle 8. A metallization also extends from the via adjacent to pin receptacles 1 and 8 comprising terminal 518, and electrically couples it to pin receptacle 7. Pin receptacle 5 is electrically coupled to pad 534 at side 608 and surface 604 of board 600.

If the headset system is to be for an open face helmet, one need only couple the microphone wires to pads 502 and 504 at side 608 of PC board 600. If the headset system is to be for a full face helmet, one then would couple the microphone wires to pads 502 and 504 at side 606 of PC board 600.

If the audio system with which the headset system is to be used requires an unamplified signal, then wires or individual conduits within the audio signal conduit (e.g., coil cord 320) or conduits (e.g., coil cords 120 and 130) would include conductors for pin receptacles 6 (terminals and 528 and 530) and 8 (terminals 504 and 520). A ground wire preferably would be provided at pin receptacle 7 (terminal 518) to improve performance. If the audio system requires an amplified audio signal, then wires or individual conduits within the audio signal conduit (e.g., coil cord 320) or conduits (e.g., coil cords 120 and 130) would include conductors for pin receptacles 7 (terminals and 502 and 518) and 8 (terminals 504 and 520).

The circuit as shown and described herein for purposes of illustrating this aspect of the invention constitutes a single amplification level with an 8-pin system. In other embodiments of the system, however, one may provide more than one amplification level, and one may utilize more than 8 pins, by using the appropriate audio signal conductor, as generally taught herein, and with the appropriate selection of conduits for inclusion in that audio signal conductor, one may accommodate more than two audio system types with a single headset system.

In accordance with another aspect of the invention, a method is provided for mounting a helmet headset system to a helmet for use with an audio system. The helmet and audio system may be as described above. For simplicity and ease of illustration, the method will be described with regard to the preferred system embodiments shown in the drawing figures and described above. It should be understood, however, that the method is not necessarily limited to implementation with these embodiments, and may be carried out using other helmet headset systems.

The method according to this aspect of the invention comprises a first step of mounting a mount to the helmet. The mount may be as described above. In accordance with the presently preferred version of this method, the mount may comprise any one of mounts 102, 202, 302 or 402.

The method includes a second step of coupling a first audio signal conduit having first and second ends to the mount so that the first end of the first audio signal conduit is coupled to the mount. The first audio signal conduit may be as described above. In accordance with the preferred method, the first audio signal conduit comprises coil cord 120 or coil cord 220 as shown in FIGS. 1 and 2, respectively.

The method also includes a third step of coupling a second audio signal conduit having first and second ends to the first audio signal conduit and to the audio system so that the first end of the second audio signal conduit is detachably coupled to the second end of the first audio signal conduit and the second end of the second audio signal conduit is coupled to the audio system. The second audio signal conduit may be as described above. As implemented in the preferred method, the second audio signal conduit comprises coil cord 130 or coil cord 230. In the preferred method, the second step includes detachably coupling the first end of the first audio signal conduit to the mount. An example is provided by connectors 128 and 136 in FIG. 1 and connectors 228 and 236 of FIG. 2.

As implemented in the preferred method, a fourth step of operatively coupling a microphone to the mount is included, as is a step of coupling at least one speaker to the mount and operatively coupling the at least one speaker to the first end of the first audio signal conduit. The microphone may be as described above, and preferably includes microphone 110 or microphone 210. The speakers may be as described above, and preferably include speakers 150 or speakers 250.

In accordance with another aspect of the invention, a method is provided for mounting a helmet headset system to a helmet for use with first and second audio systems. The method comprises a first step of mounting a mount to the helmet, as described immediately above for the previously described method. This method also includes a second step of coupling a first audio signal conduit having first and second ends to the mount so that the first end of the first audio signal conduit is coupled to the mount. This step also is as described above for the previously described method. This method also includes a third step of coupling a second audio signal conduit having first and second ends to the first audio signal conduit and to the first audio system so that the first end of the second audio signal conduit is detachably coupled to the second end of the first audio signal conduit and the second end of the second audio signal conduit is coupled to the first audio system. Again, this step is as described above in connection with the previously described method.

This method further includes a fourth step of coupling a third audio signal conduit having first and second ends to the first end of the first audio signal conduit so that the third audio signal conduit is detachably coupled to the second end of the first audio signal conduit and the second end of the third audio signal conduit is coupled to the second audio system when the second audio signal conduit is detached from the first audio signal conduit. The third audio signal conduit may be as described above for the third audio signal conduit. A preferred example of a third audio signal conduit would include coil cord 164 as shown in FIG. 1, and coil cord 264 as shown in FIG. 2. According to this method, the third audio signal conduit may be adapted to interface with a second audio system having different interface requirements than the first audio system. By detaching the second audio system conduit, for example, as illustrated in FIGS. 1 and 2, and substituting in the third audio signal conduit, the same headset system may be used with either audio system. As with the previously described method, the second step of this method may include detachably coupling the first end of the first audio signal conduit to the mount, and/or a fifth step of operatively coupling a microphone to the mount. It also may include a step of coupling at least one speaker to the mount and operatively coupling the at least one speaker to the first end of the first audio signal conduit.

In accordance with another aspect of the invention, a method is provided for mounting a helmet headset system to a helmet for use with an audio system. As with the previously described methods, this method comprises a first step of mounting a mount to the helmet. It also includes a second step of coupling an audio signal conduit having first and second ends to the mount so that the first end of the audio signal conduit is detachably coupled to the mount and the second end of the audio signal conduit is coupled to the audio system. The audio signal conduit may be as described above, and according to the presently preferred version of this method includes coil cord 320 or 364 as shown in FIG. 3, or coil cord 420 or 464 as shown in FIG. 4. The preferred version of the method includes a third step of operatively coupling a microphone to the mount. It also preferably includes a step of coupling at least one speaker to the mount and of operatively coupling the at least one speaker to the first end of the first audio signal conduit.

The preferred system embodiments and methods have been described as they can be implemented to open face and full face helmets. It will be appreciated, however, that this is not limiting. Helmet headset systems and methods as generally and broadly described herein may be applied to other helmet styles and designs in essentially the same manner. Such headset systems and methods, for example, may be used with half helmet designs using essentially the same components and methods as described herein. The microphone boom, e.g., gooseneck 112 or 312, as applied to a half helmet design would extend somewhat more downwardly, toward the coil cords, so that the microphone could be easily positioned in front of or in close proximity to the helmet wearer's mouth. The mount also may be slightly modified in known fashion to accommodate the half helmet geometry. The other components of the headset system, however, generally would be essentially the same, if not identical, relative to those described herein.

Additional advantages and modifications will readily occur to those skilled in the art. For example, the preferred embodiments and methods have been described using entirely electrical components, but it is possible to substitute such components with optical components. It is also possible to use more than two audio signal conduits. Moreover, as noted, it is possible to configure the headset system design so that more than two types of audio systems, and multiple levels of amplification, can be accommodated. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. A motorcycle helmet headset, comprising:

at least one audio transducer;

a transducer connector for electrically connecting said at least one audio transducer to a plurality of different types of motorcycle audio systems adapted for use with respective different types of audio transducers, said transducer connector having a plurality of distinct sets of connector terminals corresponding respectively to said different types of audio transducers; and an audio signal conduit adapted for interconnecting the headset with a first one of said plurality of motorcycle audio systems, said audio signal conduit having a first proximal connector adapted to interconnect with said transducer connector and thereby operatively couple to a first one of said plurality of distinct sets of connector terminals corresponding to the type of audio transducer for which said first one of said audio systems is adapted.

2. The motorcycle helmet headset of claim 1, wherein said at least one audio transducer comprises a helmet microphone that does not require an external power source, and said plurality of different types of audio transducers comprises a microphone device that requires a power source and a microphone that does not require a power source.

3. The motorcycle helmet headset of claim 2, wherein said helmet microphone is dynamic microphone.

4. The motorcycle helmet headset of claim 3, wherein said microphone device that requires a power source comprises a condenser microphone.

5. The motorcycle helmet headset of claim 1, wherein said at least one audio transducer comprises a combination dynamic microphone and microphone preamplifier device that requires a power source, and said plurality of different types of transducers comprises a microphone device that requires a power source and a microphone that does not require a power source.

6. The motorcycle helmet headset of claim 2, wherein said at least one audio transducer comprises at least one speaker.

7. The motorcycle helmet headset of claim 2, wherein said at least one audio transducer comprises at least two speakers.

8. The motorcycle helmet headset of claim 2, wherein said transducer connector and said helmet microphone are mounted to the helmet.

9. The motorcycle helmet headset of claim 2, further comprising an amplifier circuit connected between said helmet microphone and said transducer connector for matching said helmet microphone to a motorcycle audio system adapted for use with a microphone device that requires a power source.

10. The motorcycle helmet headset of claim 9, wherein said microphone device that requires a power source is a condenser microphone.

11. The motorcycle helmet headset of claim 9, wherein said microphone device that requires a power source is a combination dynamic microphone and amplifier.

12. The motorcycle helmet headset of claim 9, wherein said amplifier circuit includes an input port electrically connected to said helmet microphone, and an output port having at least three output terminals electrically connected to one of said distinct sets of connector terminals of said transducer connector.

13. The motorcycle helmet of claim 12, wherein one of said distinct sets of connector terminals includes a first one of said output terminals that is common to a second of said distinct sets of connector terminals and a second one of said output terminals that is not common to said second of said distinct sets of connector terminals, wherein said one of said distinct sets of connector terminals and said first one of said plurality of audio systems are adapted for use with an audio transducer that does not require a power source, and wherein said audio signal conduit is adapted to electrically connect said first and second output terminals together when mated mechanically with said first one of said plurality of audio systems.

14. The motorcycle helmet headset of claim 13, wherein said at least one audio transducer includes at least one speaker, wherein said audio signal conduit includes a speaker conduit for transmitting a speaker signal from the audio system to said at least one speaker, and wherein said speaker conduit is distinct from said first common output terminal.

15. The motorcycle helmet headset of claim 12, wherein said helmet microphone is a condenser microphone.

16. The motorcycle helmet headset of claim 15, wherein said at least one audio transducer comprises at least one speaker.

17. The motorcycle helmet headset of claim 15, wherein said transducer connector is mounted to the helmet.

18. The motorcycle helmet headset of claim 15, wherein said transducer connector and said helmet microphone are mounted to the helmet.

19. The motorcycle helmet headset of claim 18, wherein said at least one audio transducer comprises at least one speaker.

20. The motorcycle helmet headset of claim 1, wherein said at least one audio transducer comprises at least one speaker.

21. The motorcycle helmet headset of claim 1, wherein said at least one audio transducer comprises at least two speakers.

22. The motorcycle helmet headset of claim 1, wherein said transducer connector is mounted to the helmet.

23. The motorcycle helmet headset of claim 22, wherein said transducer is mounted to the helmet.

24. The motorcycle helmet headset of claim 1, wherein said audio signal conduit comprises a first portion and a second portion, said second portion being adapted to interconnect with said first portion, for selecting and operatively coupling said first one of said audio systems to said first one of said distinct sets of connector terminals.

25. The motorcycle helmet headset of claim 24, wherein said audio signal conduit further comprises a third portion adapted to interconnect with said first portion, for selecting and operatively coupling a second one of said audio systems to a second one of said distinct sets of terminals.

26. The motorcycle helmet headset of claim 24, wherein said at least one audio transducer comprises a helmet microphone that does not require a power source and said first one of said plurality of different types of motorcycle audio systems is adapted for use with said helmet microphone, wherein a second one of said plurality of different types of motorcycle audio systems is adapted for use with a microphone device requiring a power source, said first and second audio signal conduits portions being adapted for interconnecting said first one of said plurality of distinct sets of connector terminals with said first one of said plurality of motorcycle audio systems, said third audio signal conduit portion being adapted for interconnecting a second one of said plurality of distinct sets of connector terminals corresponding to said microphone device with said second one of said plurality of motorcycle audio systems by connecting said first audio signal conduit portion to said second one of said plurality of motorcycle audio systems.

27. The motorcycle helmet headset of claim 26, wherein said at least one audio transducer comprises a helmet microphone that does not require a power source, and said plurality of different types of audio transducers includes a microphone device that requires a power source and a microphone that does not require a power source.

28. The motorcycle helmet headset of claim 27, wherein said helmet microphone is a dynamic microphone.

29. The motorcycle helmet headset of claim 28, wherein said microphone device that requires a power source is a condenser microphone.

30. The motorcycle helmet headset of claim 28, wherein said microphone device that requires a power source is a combination dynamic microphone and amplifier.

31. The motorcycle helmet headset of claim 27, wherein said at least one audio transducer comprises at least one speaker.

32. The motorcycle helmet headset of claim 31, wherein said transducer connector and said helmet microphone are mounted to the helmet.

33. The motorcycle helmet headset of claim 27, wherein said at least one audio transducer comprises at least two speakers.

34. The motorcycle helmet headset of claim 27, wherein said transducer connector and said helmet microphone are mounted to the helmet.

35. The motorcycle helmet headset of claim 24, wherein said at least one audio transducer comprises a helmet microphone device that requires a power source to produce a first amplification and said first one of said plurality of different types of motorcycle audio systems is adapted for use with said helmet microphone, wherein a second one of said plurality of different types of motorcycle audio systems is adapted for use with a second microphone device that requires a power source to produce a second amplification different from said amplification, said first and second audio signal conduits portions being adapted for interconnecting said first one of said plurality of distinct sets of connector terminals with said first one of said plurality of motorcycle audio systems, said third audio signal conduit portion being adapted for interconnecting a second one of said plurality of distinct sets of connector terminals corresponding to said second microphone with said second one of said plurality of motorcycle audio systems by connecting said first audio signal conduit portion to said second one of said plurality of motorcycle audio systems.

36. A method for connecting a motorcycle helmet headset comprising at least one audio transducer to a selected one of a plurality of different types of motorcycle audio systems, comprising the steps of:

(a) providing a connector having a plurality of distinct sets of connector terminals corresponding respectively to the different types of motorcycle audio systems;

(b) providing an audio signal conduit adapted for interconnecting a first of said distinct sets of connector terminals with a first one of the different types of motorcycle audio systems; and (c) selecting a first set of connector terminals from among said distinct sets of connector terminals by mating said audio signal conduit mechanically to said connector, and thereby electrically coupling the selected said connector terminals to the selected motorcycle audio system.

37. The method of claim 36, further comprising adapting the audio signal conduit according to step (b) by selecting a first portion of said audio signal conduit adapted to interconnect with the selected one of said distinct sets of connector terminals, selecting a second portion of said audio signal conduit adapted to interconnect with the selected motorcycle audio system, and interconnecting said first and second portions.

38. The method of claim 37, further comprising adapting the audio signal conduit for interconnecting a second of said distinct sets of connector terminals with a second one of the different types of motorcycle audio systems by selecting at least one other first or second portion.

39. The method of claim 36, further comprising detachably operatively coupling an end of said audio signal conduit to the selected motorcycle audio system.

40. The method of claim 36, wherein the at least one audio transducer includes a helmet microphone, further comprising detachably mounting the helmet microphone to the helmet.

41. The method of claim 40, further comprising detachably mounting the helmet microphone to a boom on the helmet.

* * * * *